United States Patent [19]

Smith

[11] 3,977,568

[45] Aug. 31, 1976

[54] BIOLOGICAL FLUID DISPENSER FOR DISPENSING MICRO AMOUNTS

[75] Inventor: David S. Smith, Pittsford, N.Y.

[73] Assignee: Eastman Kodak Company, Rochester, N.Y.

[22] Filed: Jan. 8, 1975

[21] Appl. No.: 539,558

[52] U.S. Cl. ..... 222/80; 222/207; 222/420

[51] Int. Cl.[2] ..... B65D 17/00

[58] Field of Search ..... 222/80, 130, 207, 209, 222/214, 380, 381, 420; 128/218 D, 218 M, 220, 272; 210/DIG. 23, DIG. 24

[56] References Cited

UNITED STATES PATENTS

| | | | |
|---|---|---|---|
| 743,743 | 11/1903 | McCulloch | 128/220 |
| 1,557,836 | 10/1925 | Hein | 128/220 |
| 1,563,627 | 12/1925 | Hein | 128/220 |
| 2,684,068 | 7/1954 | Orens | 128/220 |

*Primary Examiner*—Robert B. Reeves
*Assistant Examiner*—David A. Scherbel
*Attorney, Agent, or Firm*—D. M. Schmidt

[57] ABSTRACT

Apparatus, featuring a dispenser, for the dispensing of biological fluids in micro amounts from a source of the fluid. The apparatus comprises a dispenser having a dispensing chamber with a platform suitable for drop formation, at least one valve controlling the flow of fluid to the chamber, and means such as a tubular passageway for joining the dispenser to a container of biological fluid.

28 Claims, 13 Drawing Figures

BIOLOGICAL FLUID DISPENSER FOR DISPENSING MICRO AMOUNTS

BACKGROUND OF THE INVENTION

1. Field of the Invention

This invention relates, for use with a fluid-providing device, to a dispensing chamber, and means for selectively transferring the fluid from its source to the chamber for drop dispensing, all without the necessity of pouring the fluid into a separate, disconnected container.

2. State of the Prior Art

The most common conventional method of providing blood serum for clinical analysis utilizes a plurality of containers in route to the actual test. That is, the blood sample is conventionally collected in an evacuated container, and separation of the serum from the whole cells may be achieved by centrifuging the sample within that container, or within another container to which the sample has been transferred. Thereafter, the serum is commonly poured off into yet another container for the desired clinical testing. All such transfer operations are time consuming, requiring either hand processing or complicated, expensive automatic handling. Furthermore, whenever there is a transfer of a liquid sample to a separate, open container, the sample is aerated and $CO_2$ loss or gain can occur. Further, there is the danger of improper transfer, either by the use of the wrong container, by the improper patient labeling of the new container, or by both. There is also the danger of contamination by foreign materials, or infection of the operator. Devices which sequentially transfer a plurality of samples to the same dispensing device require careful cleaning of the dispensing device after each use. A system which keeps the blood sample confined to essentially the same container from its collection to the actual dispensing of serum for analysis is a distinct, sought-after improvement.

One evacuated container of the prior art which is particularly useful comprises a glass tube open only at one end, a septum fixed to that end when the tube is evacuated, and a movable plug contained within the tube. The plug is preferably a silica gel, with or without a cup-like mandrel positioned with its open end pointed to the septum. The container is spun about a centrifuge axis adjacent to the septum end, and the gel, by reason of its selected specific gravity, works up to the serum-cell interface where it plugs the container against remixing of the serum and cells. An example of such a container, but without the mandrel, is shown in U.S. Pat. No. 3,852,194.

Although such a device is useful in separating the serum from the cells, it has not avoided the transfer difficulties noted above.

Valving devices have been disclosed which are to be used with such evacuated containers described above, but the use is intended only in connection with the filling of such containers. U.S. Pat. No. 3,181,529 discloses such a device.

Still another approach to the problem of separating serum from whole blood involves the use of filters. The device disclosed in U.S. Pat. No. 3,687,296 is typical of such an approach.

There is disclosed in the commonly-owned application of R. Columbus, U.S. Ser. No. 548,670, filed on Jan. 30, 1975 entitled "Metering Apparatus", now abandoned in favor of a continuation-in-part application Ser. No. 644,014, filed Dec. 24, 1975, a recent innovation in devices for metering biological fluids such as blood serum. In that application, there is provided a cup-like container especially designed to dispense precise micro amounts of blood serum repeatedly. Each container is used for only one serum sample so that, among other things, sterilization problems are avoided. However, the serum for such metering is disclosed as being prepared from blood samples by conventional methods, requiring separate containers.

Early in medical history, aspirators were constructed comprising a fluid container, a piston movable within the container, a dispensing chamber in fluid communication with the container, and a valve selectively blocking flow from the container to the chamber. An example is shown in U.S. Pat. No. 657,440 issued Sept. 4, 1900. However, such devices were not designed for, and are not suitable as, a combination blood serum separation and dispensing device.

Patents relating only to the general background of blood separating devices in general, or valving means used in the collection of body fluids include the following U.S. Pat. Nos. 3,143,109; 3,308,809; 3,520,292; 3,661,265; 3,701,434; 3,750,645; 3,780,935 and 3,814,248.

OBJECTS OF THE INVENTION

It is an object of the invention to provide a biological fluid dispenser which permits dispensing of the fluid directly in a closed container from a source of fluid without pouring into a disconnected, open container.

It is a related object of the invention to provide such a dispenser in a disposable form after one use.

Yet another object of the invention is to provide such a dispenser which will be useful in combination with at least one existing blood serum separating container.

Other objects and advantages will become apparent upon reference to the following Summary and Description of Preferred Embodiments, when considered together with the attached drawings.

SUMMARY OF THE INVENTION

The invention concerns a dispenser useful in combination with a source of biological fluids, such as conventional blood separators. More specifically, there is provided a dispenser for use with a biological fluid container comprised of a stoppered tubular member defining a compartment for fluid, the dispenser comprising at least one valve capable of being secured adjacent one end of the compartment, a dispensing chamber, and passage means for fluidly connecting the chamber to the compartment, the passage means being selectively blocked by the valve and including means for penetrating the tubular member stopper. The combination of the dispenser and fluid-providing container provides a useful means for dispensing the fluid, particularly in the case of blood serum fluid.

DESCRIPTION OF THE PREFERRED EMBODIMENTS

The invention is intended primarily for use in the dispensing of blood sera directly from blood separators onto suitable substrates, for clinical analysis. Typical of such substrates are those shown, for example, in commonly owned U.S. application Ser. No. 588,755, entitled "Improved Multilayer Analytical Element for Clinical Analysis", filed by B. Bruschi on July 20, 1975. However, the apparatus of this invention is neither limited to use with just such substrates, nor to just the dispensing of drops of blood sera, other fluids being similarly dispensable with apparatus of the type described. Although drops of sera are described hereinafter by way of example, the apparatus may be used to transfer the sera in a large quantity, as by ejecting a stream. Also, although the following description refers to the use of a particular blood separator, the invention is not limited thereto and may be used in conjunction with any container of biological fluid.

Figure 2:
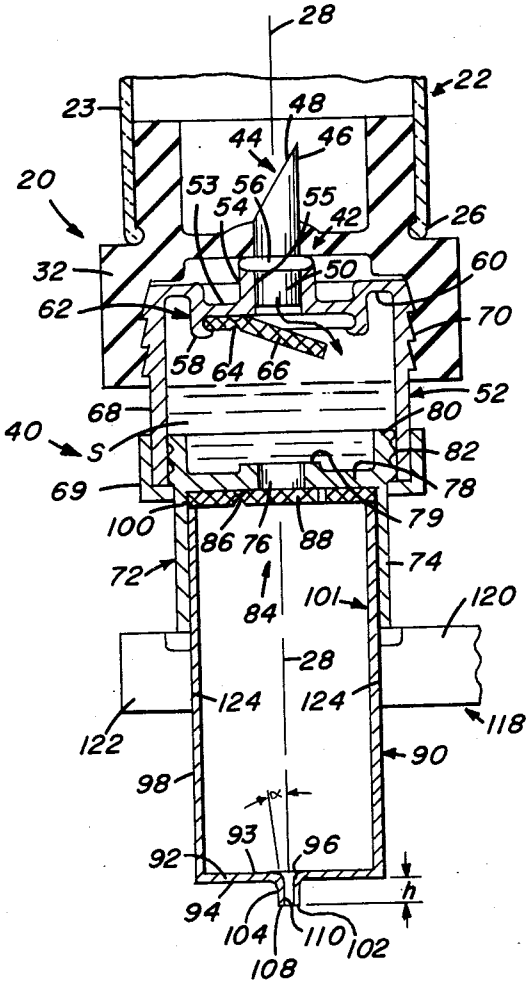
FIG. 2 is a view similar to FIG. 1, but illustrating the step of transfer of the serum from the serum separator to the piston cylinder.
Figure 1:
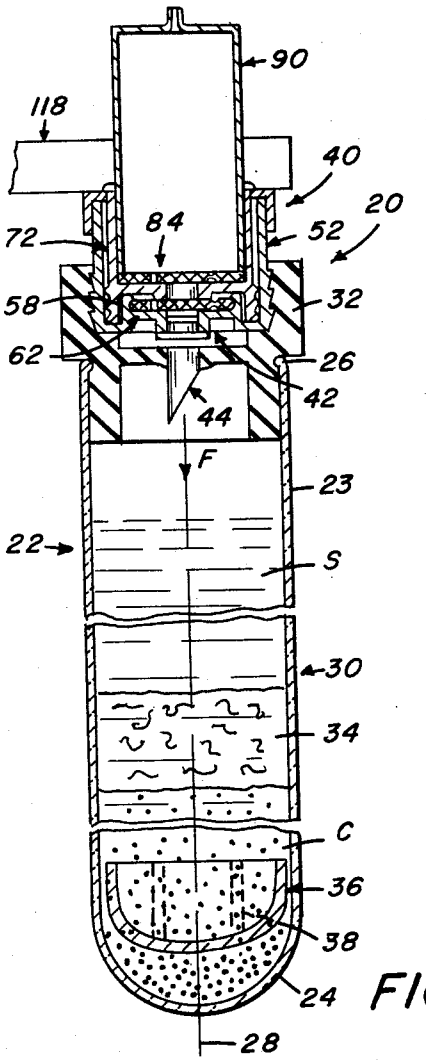
FIG. 1 is a fragmentary elevational view partially in section of serum dispensing apparatus constructed in accordance with the invention, illustrating the serum after centrifuge and prior to transfer to the dispensing chamber.

Turning now to FIGS. 1 and 2, in accordance with one aspect of the invention, there is illustrated the combination of a blood separator container 22 and a serum dispenser 40 joined to the container 22.

BLOOD SEPARATOR

As shown, the container 22 is a walled member, such as glass tube 23 closed at one end 24 and open at end 26, in which a biological fluid such as blood serum S is provided. A particularly useful form of such container is one in which, along the longitudinal axis 28 of the tube, the serum S is separated from blood cells C, and a plug 30 disposed at the interface of the serum and cells to block flow through the container, thus preventing remixing of serum and cells. A closure member or stopper 32 seals end 26. The separator functions to separate the blood components during the application of a centrifugal force F along the longitudinal axis 28. The plug can comprise silica gel 34 having a specific gravity generally between that of the serum and the cells. The plug moves during centrifuging from its initial position, usually adjacent the closed end 24, to the interface. Typically, the gel can be a blend of hydrophobic silicon dioxide and a silicone. If the gel is used by itself without a mandrel, as is taught for example in the aforesaid U.S. Pat. No. 3,852,194, the silicone can be dimethylpolysiloxzane, blended to give a thioxtropic gel having a specific gravity between about 1.03 and 1.05, and preferably about 1.04. This places the gel between the range of specific gravities normally obtained for serum and the blood cells, namely 1.024 to 1.031, and 1.050 to 1.064, respectively. In addition, a mandrel 36 can be incorporated with the gel at the end 24 to assist in transfer of the gel during centrifuging, but because of its specific gravity (1.186) the mandrel remains at end 24. The mandrel may be provided with ribs 38 and glass beads, not shown, or other means, to aid in the clotting of the cells.

A representative separator of the above type is manufactured by Corning Glass Works, Corning, New York, under the trademark "Corvac".

DISPENSING MEANS

It will be appreciated that, prior or subsequent to the centrifuging operation, the dispenser 40 is secured, FIG. 1, to the blood separator for the dispensing sequence. The dispenser 40 comprises passage means 42 which permits fluid flow of the serum from the tube 23 into the dispenser, at least one valve 62 disposed adjacent to the serum or open end 26 of the container 22, a dispensing chamber 90, and means 118 for forcing the serum out of the chamber under pressure in dispensed amounts.

More specifically, the passage means, FIG. 2, includes tubular member 44 having an entrance end 46 formed with preferably diagonally extending exterior surface 48 for penetrating through closure member 32 into the compartment 22, and an opposite end 50 to which a hollow member or cylinder 52 is secured. The cylinder 52 terminates at end 53 in a neck 54 defining an aperture 55. Neck 54 sits on collar 56 of tubular member 44 so that one end of member 44 is confined in aperture 55. End 53 further includes a valve-holding flange 58 and a recessed annulus 60 surrounding the flange 58 for reception of a piston 72, described hereafter. Seated and held within the flange 58 is valve 62, which is here shown to be a flap valve having a flexible neck portion 64 and a movable cut-away head 66. From end 53, the cylinder body extends outwardly in cylindrical walls 68 to a stop ring 69, the exterior surface of the walls preferably being provided with locking ribs 70 that engage the stopper 32. Alternatively, the tubular member 44 can be integral with the neck 54 of cylinder 52.

Figure 3:
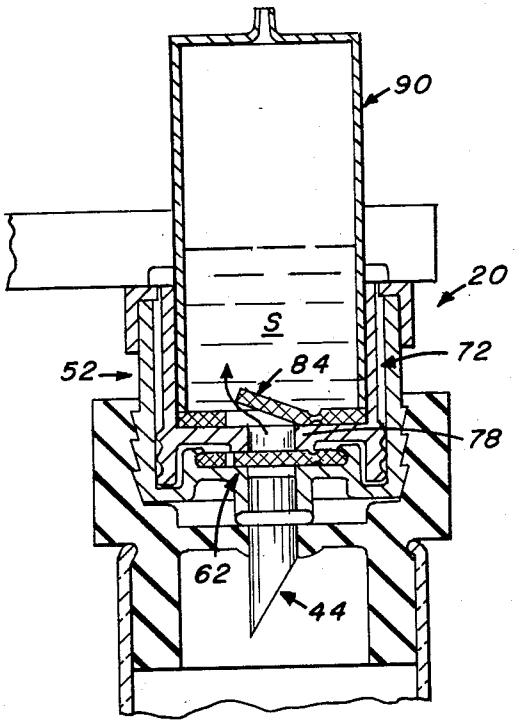
FIGS. 3 and 4 are views similar to FIGS. 1 and 2, illustrating the subsequent steps of transferring serum from the cylinder to the chamber and of dispensing drops of the serum, respectively.

Telescoped within the cylinder 52 for reciprocal movement is means for reducing the air pressure in the vicinity of valve 62. Specifically, there is provided piston 72, comprised of dispensing chamber 90 and a second hollow member 74 tightly secured around the exterior of chamber 90, as by adhesive. Both the member 74 and the chamber 90 are hollow for their entire lengths. Member 74 has an aperture 76 at one end 78, which defines one end of the piston, shoulders 79 which return valve 62 to its closed position (FIG. 3), and flanges 80 which extend into recessed annulus 60 of the cylinder. Piston rings 82 can be molded into the exterior surface of the flanges 80, or separator piston rings can be provided. Immediately adjacent to end 78 and forming the exit end of passage means 42 is a second valve 84 secured within the piston so as to fill the space between the chamber 90 and the end 78. As with valve 62, valve 84 is preferably a flap valve formed with a neck portion 86 and a head 88.

The dispensing chamber 90 is preferably that which is disclosed and claimed in the aforesaid Columbus U.S. application Ser. No. 545,670, entitled "Metering Apparatus". Such chamber preferably comprises a cup-like device having an end closure wall 92 with opposed faces 93 and 94, and an aperture 96, opposed side walls 98 extending from face 93 of the wall 92 and terminating in a shoulder 100 to define a first compartment 101, and a specially constructed drop-forming tip or platform 102 spaced away from and connected to face 94 of the end wall. A convenient shape of the walls 98 is that which provides a generally conical or cylindrical form, but other forms are obviously as useful.

Because the preferred use of the invention is to dispense a plurality of drops, one at a time, for analysis, it is essential that the compartment 101 have an accommodating capacity sufficient to dispense all the drops to be tested without refilling. Specifically, due to the number of tests normally run on a single sample, the compartment desirably has a capacity which is equal to at least about 100 $\mu$l and preferably up to about 1000 $\mu$l The lower amount of this range would be used by patients having a limited blood supply, such as infants.

Figure 5:
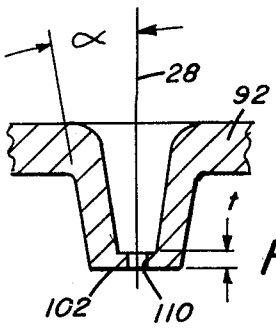
FIG. 5 is an enlarged fragmentary section of the platform of the chamber, illustrating an alternate construction therefor.
Figure 4:
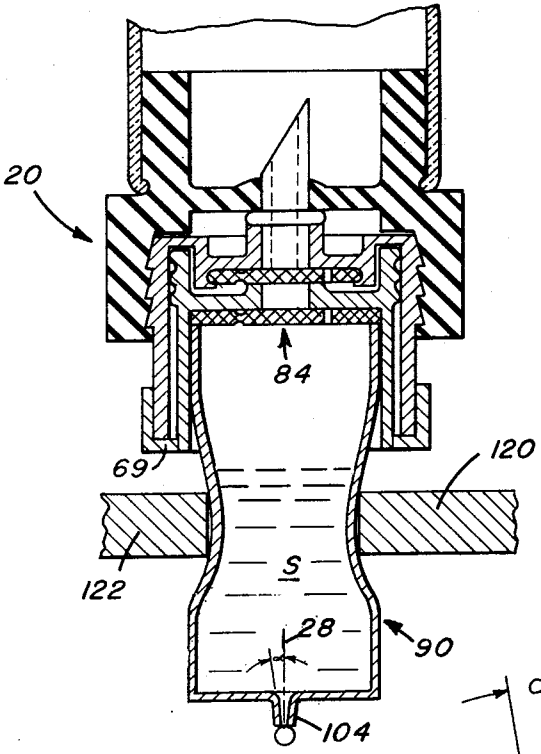

As also is disclosed in said Columbus application, the platform 102 is generally a flat surface and may be in the form of a separate wall surface which is joined by walls 104 to the wall 92, as shown in FIGS. 1–4, or it may be a part of wall 92, isolated from the rest of the container. The platform 102 preferably is removed from the remaining container portions by a distance $h$ which is sufficient to prevent a drop of blood serum from spreading from the platform to these remaining chamber portions prior to drop transfer. Such drop spreading would interfere with accurate drop transfer. It has been found that a suitable value for this distance $h$ is about 0.127 cm. Furthermore, the surface of the walls 104 preferably are sloped away from axis 28, along which the force of gravity acts when the drop is formed, FIG. 4, by an angle $\alpha$ which is between 0 and about 15 degrees. Any slope greater than this will encourage the drop formed on the platform, FIG. 4, to spread up the walls 104, thus interfering with the proper drop size and drop removal. The surface of the platform terminates in relatively sharp edges 108, which are defined by the platform surface's intersection with the walls 104. The platform also has an aperture 110 in fluid communication with compartment 101 via aperture 96. The surface connection provided by walls 104 between aperture 96 and aperture 110 may be smooth as shown, or stepped down, FIG. 5.

Further as described in said Columbus application, to insure that blood serum of the types commonly received from patients are properly dispensed as a drop from platform 102, in accurate micro-amounts, it has been determined further that the chamber 90 should have the additional following properties:

1. Aperture 110 preferably has a maximum dimension at the exterior surface of platform 102, measured transversely to fluid flow therethrough, which is less than that which will permit flow of blood serum under the influence of gravity and which is large enough to prevent closure of the aperture as by protein agglomeration. To perform this function with the normal range of sera having a surface tension of between about 40 dynes/cm and about 65 dynes/cm, and a relative viscosity no greater than about 2 centipoises, it has been found that the maximum dimension should be between about 0.025 and about 0.046 cm. A particularly useful embodiment is one in which the aperture 110 is generally circular in shape, with the circle diameter being this maximum dimension.

2. Edges 108 preferably are sufficiently sharp as to prevent the tendency of the serum drop to climb up the walls 104 under the influence of surface tension. It has been found that the maximum radius of curvature which will still prevent such an effect is preferably about 0.02 cm.

Furthermore, the walls 92 and 98 are desirably strong enough to withstand, without permanent deformation, the forces incident in the handling of the container, as well as the pressurizing forces described hereafter. In view of the fact that automatic handling of the chamber 90 can be utilized, the forces which might be encountered can be as high as 0.173 K/cm$^2$.

If the platform 102 is constructed as shown in FIG. 1, it is preferable that the dimension for aperture 96 be considerably greater than that of aperture 110, so as to slope the inner surface of wall 104 with respect to axis 28, to avoid presenting to the serum a long narrow constriction capable of protein agglomeration. Thus, for a distance of about 0.2 cm between the two apertures, the diameter for aperture 96 can be between about 0.076 cm and about 0.15 cm, for an aperture 110 dimensional as noted above. Alternatively, if the platform 102 is given a separate wall configuration, FIG. 5, then it should have a cross-sectional thickness $t$, measured along a plane extending perpendicular through the platform, which is less than such cross-sectional thickness of wall 92, and in any event is no greater than about 0.026 cm. Otherwise, a thicker wall for platform 102 will encourage protein agglomeration which could plug aperture 110. A particularly useful thickness is about 0.013 cm.

Still other properties which are disclosed in said Columbus application as being of lesser importance, but which do improve the drop formation and transfer, concern the smoothness of the exterior platform surface measured between the edges 108. That is, the surface smoothness which gives best results is one generally between about 1 and 30 RMS. The overall platform diameter will depend of course on the size of drop which is desired, and for drop volumes which might range from 1 to 30 $\mu$l, the diameter is preferably between about 0.076 and 0.152 cm.

All of the above features can be obtained by forming the container 90 out of copolymers such as acrylonitrilebutadiene-styrene (ABS), and polymers such as acetal, polypropylene, polystyrene, high density polyethylene, and polyesters. Typical thicknesses for walls 32 and 38, in the case of ABS copolymers, include for example 0.076 cm.

The pressurizing means for forcing serum from the chamber out onto platform 102 is shown in FIGS. 1 through 4 as including means 118 for displacing the side wall 98 inwardly towards each other, and more specifically, a pair of relatively movable jaws 120 and 122 each having bearing surfaces 124 in contact with the exterior surface of walls 98. The jaws may be pivoted together, not shown. For this displacement, the walls 98 must also be sufficiently flexible to permit such displacement in an amount sufficient to expel from compartment 101 at least one, and preferably many, drops of serum. Because each drop forms only microliter volumes no greater than 30 $\mu$l, and preferably between about 8 and about 13 $\mu$l, the inward displacement for each drop is of relatively small magnitude.

With regard to all of the Figures of the drawings, the vertical orientation shown is to be understood to be that of the preferred process or use unless otherwise stated. Such process by which all types of sera can be dispensed is as follows: As described above, the dispensing means 40 is secured to the container 22 by forcing the tubular member 44 through, and ribs 70 into, stopper 32, after serum separation is complete. This may be done with the container 22 oriented as shown in FIG. 1, or inverted with stopper 32 down. In either case, the next step should be done with stopper 32 in the down position, FIG. 2, at which time the piston 72 is pulled downwardly. This action causes the end 78 of the piston to pull away from end 53 of the cylinder 52, and valve 62 opens under the influence of the partial vacuum or reduced pressure formed in the passage means 42 with respect to container 22. Such vacuum serves also to keep valve 84 closed. The serum S thus flows as shown by the arrow from the serum end 26 of the container 22 through passage means 42 and into cylinder 52. Next, FIG. 3, the apparatus is inverted and piston 72 is pushed back until end 78 thereof is again in contact with valve 62. The differential pressure thus generated in cylinder 52 closes valve 62 and opens valve 84 to force the serum into the dispensing chamber 90. It will thus be appreciated that piston 72 functions both as an evacuating means and as a pressurizing means. Serum is thus prevented from returning to container 22. To dispense drops from the chamber, FIG. 4, the apparatus is reinverted with the chamber 90 down, and the jaws 120 and 122 are squeezed together an amount sufficient to force out a drop. Such squeezing affects an increase in air pressure in the chamber, due to the valve 84 remaining closed under pressure. A representative force applied to a 0.076 cm wall 98 of chamber 90, made from an ABS copolymer to eject one drop of a typical blood sera is about 1 kilogram per square millimeter. The drop is removed from the platform preferably by touching it to a suitable substrate capable of use in clinical analysis of the drop.

Other means for pressuring the chamber can be used, as will be apparent to one skilled in the art.

As reported in the aforesaid Columbus application, it has been found that a container 90 constructed as described above, when the contents are appropriately pressurized, repeatedly will give uniform volumetric drops of biological fluid, such as blood sera, even when the relative viscosity, surface tension and total protein content varies drastically as is characteristic of blood sera drawn from diseased as well as healthy patients. Such control of volume is essential to insure that the same potential for the tested component exists in each drop. That is, enlarged drops can give in some tests a falsely greater reading due to the absolute increase in component thus obtained. Instead, uniform concentrations are preferred.

In this and any other embodiments, appropriate surface treatment can be given to the passage means 42 to increase the wettability of those parts, whereby fluid transfer is improved. Typical treatments include physical abrasion, ozone exposure, or chemical coatings, applied to the surface to be wetted.

Figure 7:
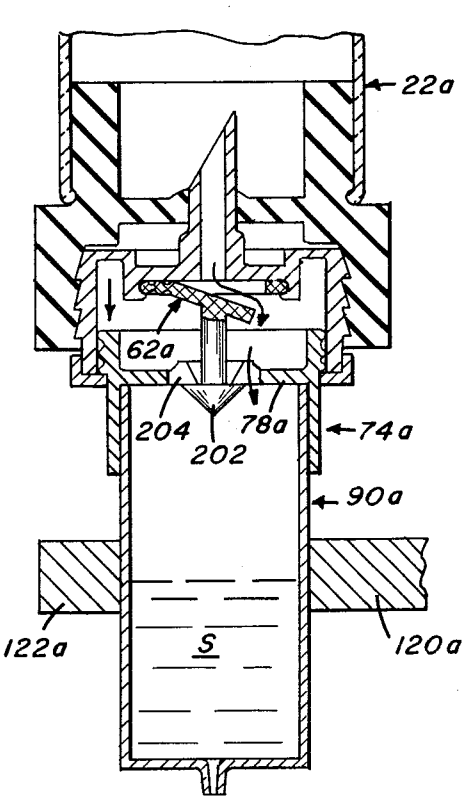
FIGS. 6–8 are fragmentary elevational views in section similar to FIG. 1, but illustrating alternate embodiments of the invention.
Figure 6:
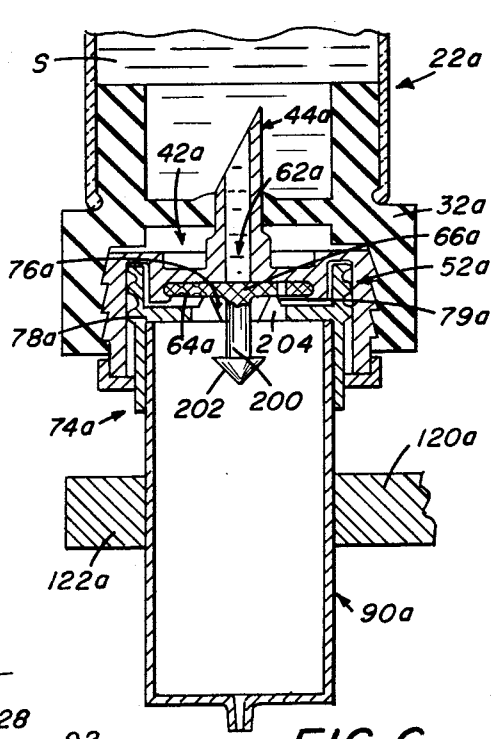

Turning now to FIGS. 6 and 7, there is illustrated an alternate embodiment of the invention wherein only a single valve is required to control the flow of serum S from the container to the dispensing chamber. Parts similar to those previously described bear the same reference numeral, to which the distinguishing suffix *a* has been added. Thus, container **22*a*, stopper 32*a*, chamber 90*a* and hollow member 52*a* are the same as before, having the same contents, the tubular member 44*a* being integral with the member 52*a* to partially define the passage means 42*a*. However, flap valve 62*a* in addition to the neck and head portions 64*a* and 66*a*, comprises a column 200 which projects into the dispensing chamber 90*a* and terminates in a button 202. The second hollow member 74*a* is correspondingly modified so that end 78*a* formed as before with aperture 76*a* and shoulders 79*a*, is provided with cutout portions 204 on both sides of the aperture 76*a*. Furthermore, the aperture 76*a* itself has a maximum diameter which is less than the outside diameter of buttom 202. The result, FIG. 7, is that the lowering of member 74*a* causes end 78*a* to pull the button 202 down, thus opening flap valve 62*a*. The serum S pours from container 22*a* as shown by the arrows, FIG. 6, through cut-out portions 204 into the chamber 90*a*, to be subsequently dispensed by the actuation of jaws 120*a* and 122*a*. Prior to pressurizing the chamber in the manner described for the previous embodiments, the apparatus is oriented generally horizontally, preferably, and the valve 62*a* is closed by returning the hollow member 74*a* to the closed position shown in FIG. 6**.

By this structure, the need for a second valve is eliminated, as well as the necessity for repeated inversions of the apparatus.

In FIGS. 8–12, there are illustrated two other embodiments each featuring a single valve, but which are rotary valves. The valves are characterized as being two-way operative, depending on the orientation of the apparatus, and because they operate by shear action, no piston action is required. Parts similar to those previously described bear the same reference numeral to which the distinguishing suffix *b* and *c*, respectively, have been added.

Figure 10:
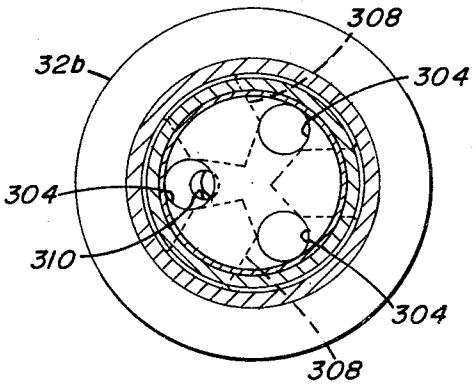
FIG. 10 is a sectional view similar to FIG. 9 but illustrating the open mode.
Figure 9:
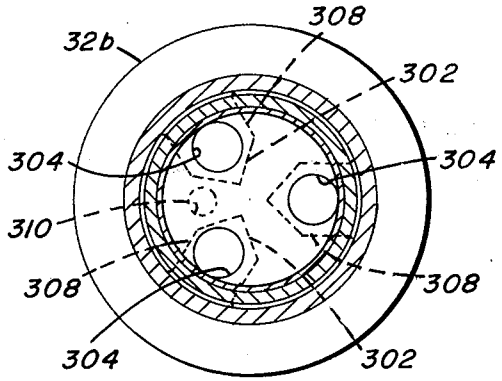
FIG. 9 is a sectional view taken generally along the line IX—IX of FIG. 8 to illustrate the closed mode of that embodiment.
Figure 8:
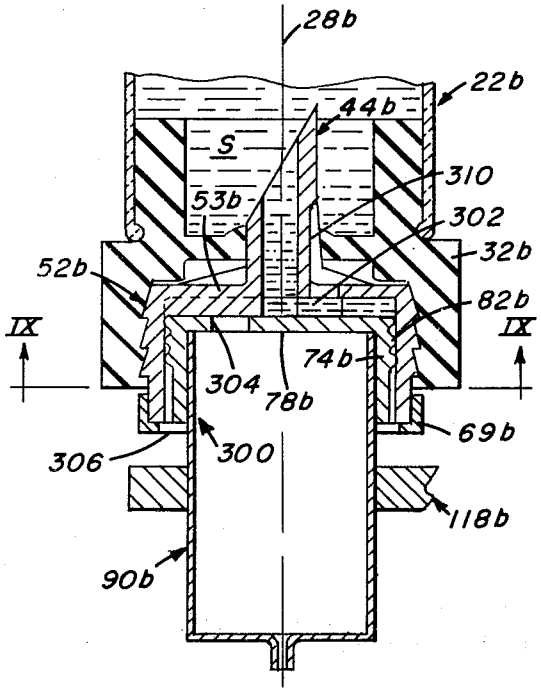

Thus, in FIGS. 8–10, the container **22*b*, stopper 32*b*, chamber 90*b*, and pressurizing means 118*b* are the same as in the first two embodiments. However, the flap valve of the previous constructions has been replaced by a single rotary valve 300, which comprises the second hollow member 74*b*, rotatably mounted about axis 28*b* within the first hollow member 52*b*. The member 52*b* further is provided, in end 53*b*, with at least one and preferably three openings or notches 302 spaced 60° apart, FIG. 9, each of which extends radially outwardly from the tubular member 44*b*. The end 78*b* of hollow member 74*b* has at least one, and preferably three corresponding passageways 304 offset from said axis 28*b*. Ribs 82*b* serve in this case to guide member 74*b* for rotation within member 52*b*. Stop ring 69*b* is further modified to include a spring pressure flange 306 which extends into contact with the outer end of the member 74*b*, whereby member 74*b* is prevented from reciprocal movement within member 52*b* and is held firmly seated in member 52*b***.

As shown in FIG. 9, when valve 300 is rotated an angle of 60° about axis **28*b*, the passageways 304 align with the notches, thus permitting flow out of container 22*b* into chamber 90*b* when the chamber is oriented in the down position as shown in FIG. 8. By providing notches 302 with increased width at their outer circumference, as at portions 308, FIGS. 9 and 10, the volume into which the serum pours after passage through the tubular member 44*b*** becomes larger so as to encourage rapid transfer into the chamber. However, the precise shape of the enlargement of the notches is not critical.

To encourage air transfer upwardly to container 22b, a vent 310, FIG. 8, can be provided in the outer surface tubular member 44b, extending all the way from one of the notches 302 into container 22b. Because of the increased air transfer, the serum will empty faster into chamber 90b.

It will be appreciated that pressurizing means 118b can also serve as means for rotating valve 300.

Figure 11:
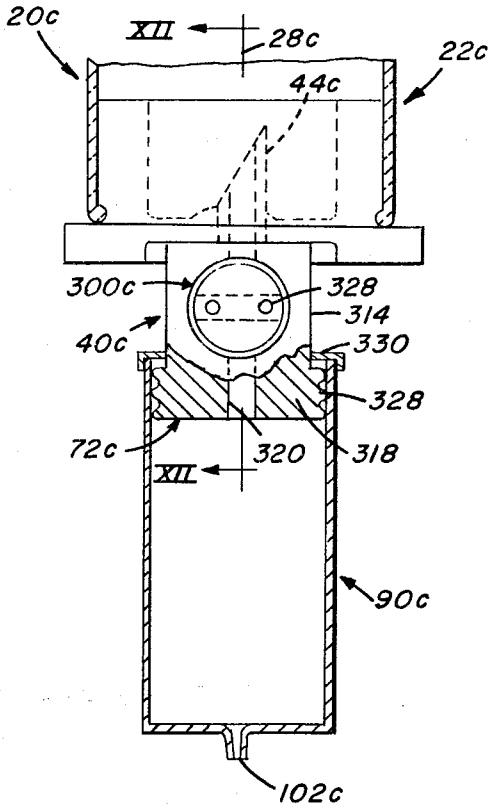
FIG. 11 is a fragmentary, partially sectioned elevational view similar to FIG. 1, but illustrating still another embodiment.
Figure 12:
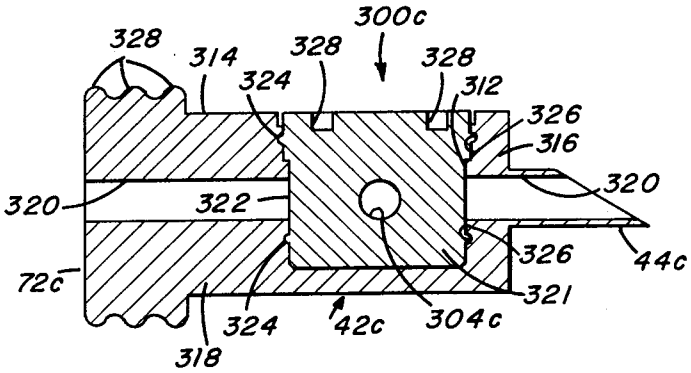
FIG. 12 is a sectional view of only a portion of the dispenser, taken along the line XII—XII of FIG. 11.

In FIGS. 11 and 12, apparatus 20c has a dispensing means 40c wherein the rotary valve 300c is mounted to rotate about an axis normal to the axis 28c of container 22c. In this case, the rotary valve is mounted in a cylindrical bore 312 (FIG. 12) of passage means 42c. Passage means 42c in turn comprises a hollow member 314 integrally connected at one end 316 to a penetration tube 44c, and is provided at its opposite end 318 with a piston 72c. A fixed bore or opening 320 extends through member 314 from both ends 316 and 318, generally perpendiularly to bore 312. In detail, valve 300c comprises a plug 321 the exterior surface 322 of which is fitted to turn within the bore 312. Thus, at least one and preferably two circumferential ribs 324 can be molded into surface 322, to coincide with and fit into matched grooves 326 formed or molded into the bore 312. A single passageway 304c extends through plug 321 perpendicular to the bore 312, positioned so as to align with bore 320 when the plug 321 is rotated into the correct position. To aid in such rotation of the plug, orifices 328 can be formed in the exterior face of plug 321 spaced away from the axis of rotation to receive a driving member.

In this embodiment, the pressurizing of the chamber 90c, constructed as described above, is achieved by means of the telescoping relationship of the chamber 90c with respect to hollow member 314. More specifically, the dispensing chamber 90c also functions as a piston cylinder with respect to piston 72c formed at end 318 of member 314. Piston rings 328 can be molded or otherwise formed on the surface of the piston. A stop ring 330 is secured to end 100c of the chamber 90c, or the chamber may be molded with the ring as an integral part of the chamber wall. In operation, the stop ring is in contact with the first piston ring 328 when valve 300c is to rotated from the closed position shown, FIG. 11, into its open position. After such rotation and filling of the chamber 90c, the valve is rotated back to the closed position, and thereafter need not be rotated any further. The chamber 90c can be pushed up along hollow member 314 an amount sufficient to generate the pressure within the chamber which is required to form a drop on the platform 102c of the chamber.

Figure 13:
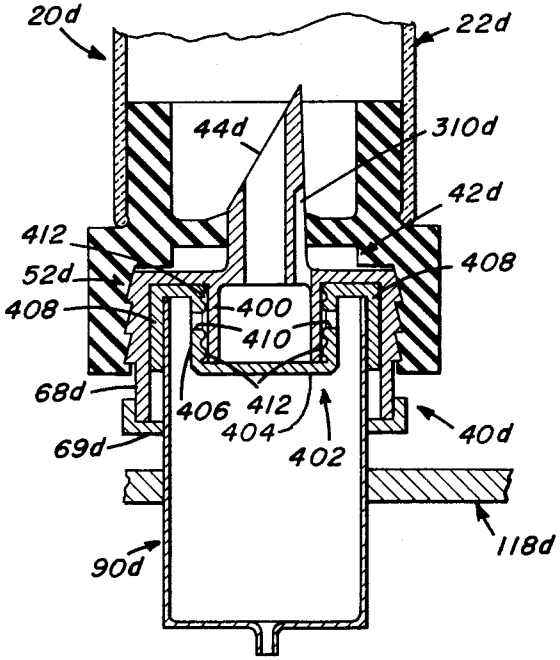
FIG. 13 is a fragmentary sectional view similar to FIG. 1, but illustrating yet another embodiment.

FIG. 13 illustrates yet another embodiment wherein the single valve is a two-way shear valve, as in the case of FIG. 11, but relies upon reciprocation for its opening and closing, rather than rotation. Parts similar to those previously described bear the same reference numeral, to which the distinguishing suffix *d* has been added. Thus, apparatus 20d includes the same container 22d and a tubular member 44d penetrating into the container, and a dispensing chamber 90d constructed as in the embodiment of FIG. 1. However, the hollow member 52d which is integral with tubular member 44d is altered so as to have a fixed tube 400 which acts as a linear extension of member 44d. The valve in this case is a hat-shaped member 402 which comprises a blocking face 104, side walls 406 which reciprocate in contact with the exterior surface of tube 400, and returns 408 which fit within the walls 68d of member 52d. Walls 406 have at least one aperture 410 and preferably two. Preferably, the piston rings 412 are formed integrally with interior surface of walls 406. Stop ring 69d is positioned to limit the movement of valve 402 so that in the extended position, with chamber 90d oriented downwardly, the apertures 410 clear the tube 400 and permit flow of serum from the passage means 42d defined by members 44d and 52d, into the chamber 90d. By reciprocating valve 402 back into the position shown, the apertures are blocked by the tube 400, as in the case when pressurizing means 118d are actuated as in the previous embodiments. The reciprocation to the closed position creates a piston effect only with respect to the container 22d, when apertures 410 are first closed, as some serum will be pushed back into the tube 400 by face 404. As with the other embodiments, an air vent 310d can be provided in tubular member 44d and dispensing means 40d can be attached to container 22d with the chamber 90d below it, as shown.

The invention has been described in detail with particular reference to certain preferred embodiments thereof, but it will be understood that various and modifications can be effected within the spirit and scope of the invention.

What is claimed is:

1. Apparatus for dispensing biological fluid in micro amounts, comprising a container for the fluid and means joined to the container for dispensing the fluid; the container comprising a walled member defining a compartment, and a closure member at one end of the container;

said means comprising 1. at least one valve disposed adjacent said one end of said compartment,
2. a dispensing chamber and
3. passage means for fluidly connecting the chamber to the compartment, said passage means being selectively blocked by said valve and including a tubular member one end of which extends through said closure member, and a hollow member connected to said tubular member, the interior of said tubular member being in fluid communication with said hollow member to fluidly connect the hollow member to said compartment, said chamber being disposed at least partially within said hollow member.

2. Apparatus as defined in claim 1, and further including a piston having oppositely disposed ends, said piston being slidably mounted within said hollow member, one of said piston ends being positioned movably adjacent said valve, said piston including said dispensing chamber.

3. Apparatus as defined in claim 1, and further including a second valve secured between said chamber and said tubular member, said valves permitting flow of biological fluid out of said compartment and into said chamber.

4. Apparatus as defined in claim 3 wherein said valves do not permit flow into said compartment or out of said chamber.

5. Apparatus as defined in claim 3 wherein said valves are flap valves.

6. Apparatus as defined in claim 1 wherein said valve is a shear valve operating to block said passage means when a shear force is applied between the valve and a portion of said passage means.

7. The apparatus as defined in claim 6 wherein said passage means includes a fixed opening in said hollow member for constant fluid communication with said container, and said valve has at least one passageway and is rotatably mounted about an axis so as to movably align the passageway with said fixed opening, and further including means for rotating said valve passageway into and out of alignment with said opening.

8. The apparatus as defined in claim 7 wherein said axis of rotation of said valve coincides with said compartment axis.

9. The apparatus as defined in claim 6 wherein said hollow member includes a fixed tube, and wherein said valve includes a hat-shaped member concentrically mounted around the exterior of said tube for relative reciprocal movement, said hat-shaped member having at least one aperture in the walls thereof which is reciprocated in contact with said tube, said tube, hat-shaped member, and one aperture being relatively positioned so that at one end of said reciprocal movement, said one aperture is blocked by said tube, and at the other end of said movement, the aperture permits fluid communication between said hollow member and said dispensing chamber.

10. The apparatus as defined in claim 1, wherein said chamber further comprises:

a first wall having an inner and an outer surface, and opposed side walls extending from said inner surface to define a container for the fluid sufficient to permit at least one drop to be dispensed therefrom; and a platform having an aperture in fluid communication with said container, said aperture having dimensions which preclude gravitational flow of the fluid from the chamber;

said platform and said first wall being connected in a manner which is sufficient to prevent spreading of drops of dispensed fluid onto said outer surface;

said platform having an exterior surface defining a drop-contacting area which will support a properly-formed drop of predetermined volume, said volume being substantially fixed and within the range of about 1 and about 30 $\mu$l.

11. The apparatus as defined in claim 10 wherein said platform has a cross-sectional thickness taken along a plane extending perpendicular to said platform less than that of said end wall and no greater than about 0.026 cm.

12. Apparatus for dispensing biological fluid in micro amounts, comprising a container for the fluid and means joined to the container for dispensing the fluid;

the container comprising a walled member defining a compartment, and a closure member at one end of the container;

said means comprising 1. at least one valve disposed adjacent said one end of said compartment,
2. a dispensing chamber,
3. a cylinder secured to one end of said compartment, said chamber being reciprocally mounted within said cylinder, said valve being positioned within said cylinder between said compartment and said chamber, and
4. passage means for fluidly connecting the chamber to the compartment, said passage means being selectively blocked by said valve and including a tubular member one end of which extends through said closure member, the interior of said tubular member being in fluid communication with said cylinder to fluidly connect the cylinder to said compartment, said valve being disposed at least partially within said cylinder and between said tubular member and said chamber.

13. Apparatus as defined in claim 12, and further including a second valve positioned within said cylinder to selectively block fluid flow from said chamber into said cylinder and to permit fluid flow into said chamber.

14. Apparatus as defined in claim 12, and further including means for reciprocating said chamber with respect to said cylinder.

15. Apparatus for dispensing biological fluid in micro amounts, comprising a container for the fluid and means joined to the container for dispensing the fluid;

the container comprising a walled member defining a compartment, and a closure member at one end of the container;

said means comprising 1. at least one valve disposed adjacent said one end of said compartment,
2. a dispensing chamber and
3. passage means for fluidly connecting the chamber to the compartment, said passage means being selectively blocked by said valve and including means for penetrating said closure member, said dispensing chamber being defined by opposing side walls joined at one end to form a closure, and a drop-forming tip extending from said closure, said side walls being sufficiently flexible as to permit their displacement towards each other in an amount sufficient to expel at least one drop of biological fluid from said chamber when said passage means is blocked by said valve.

16. Apparatus as defined in claim 15 and further including means for displacing said side walls toward each other.

17. Apparatus as defined in claim 16 wherein said displacing means include a pair of jaws movable with respect to each other, said jaws having a bearing surface in contact with the exterior surface of said chamber side walls.

18. Apparatus for the dispensing of biological fluid in micro amounts comprising a container for the biological fluid and means joined to the container for dispensing the fluid;

the container comprising a walled member defining a compartment and a closure member at one end of the compartment;

said dispensing means comprising 1. a dispensing chamber,
2. passage means for fluidly connecting the chamber to the compartment, said passage means including a tubular member one end of which is capable of projecting into said compartment to define said entrance end, and a hollow member connected to said tubular member, said chamber being mounted at least partially within said hollow member, said passage means having an entrance end within said compartment and an exit end removed from said compartment,
3. at least one valve positioned between said entrance and exit ends to selectively block said passage means, said valve being capable of fluid flow through the passage means, only towards said exit end in response to a differential pressure across the valve, and 4. evacuating means for reducing the pressure in said passage means with respect to said compartment so as to cause flow of biological fluid through said valve.

19. Apparatus as defined in claim 18 and further including a second valve positioned so as to selectively block flow of biological fluid from said one valve to said chamber, said second valve being capable of fluid flow only into said chamber in response to a differential pressure across said second valve;

and pressurizing means for increasing the pressure within said hollow member with respect to said chamber so as to cause flow of fluid through said second valve.

20. A dispenser for use with a biological fluid container comprised of a tubular member defining a compartment for holding fluid and a stopper at one end;

the dispenser comprising 1. at least one valve capable of being secured adjacent to the one compartment end,
2. a dispensing chamber, and
3. passage means for fluidly connecting the chamber to the compartment, said passage means being selectively blocked by said valve and including a tubular member one end of which is capable of penetrating into the compartment, and a hollow member connected to said tubular member, said valve being disposed at least partially within said hollow member and between said tubular member and said chamber, said hollow member and said chamber being movably telescoped together, whereby one of said hollow member and said chamber functions as a piston with respect to the other of said hollow member and said chamber.

21. The dispenser as defined in claim 20 wherein said dispensing chamber is defined by opposing side walls joined at one end to form a closure, and a drop-forming tip extending from said closure, said side walls being sufficiently flexible as to permit their displacement towards each other in an amount sufficient to expel at least one drop of fluid from said chamber when said passage means is blocked by said valve.

22. The dispenser as defined in claim 20 wherein said chamber includes an end wall having opposed faces, and opposed side walls extending from one face of the end wall, said end wall having an aperture;

a platform spaced away from the remainder of said end wall by a distance sufficient to prevent dispensed Biological Fluid from contacting said other face;

the surface of said other face immediately adjacent the platform being inclined at an angle of not more than about 15° measured with respect to the axis along which the force of gravity acts with respect to a drop on the platform;

the exterior surface of the platform terminating in shape edges having a radius of curvature no greater than about 0.02 cm;

said platform having a generally circular aperture with a diameter smaller than that which will permit gravity flow from the chamber of fluid having a surface tension of between about 40 dynes and about 65 dynes/cm, and a relative viscosity of no greater than about 2 centipoises.

23. The dispenser as defined in claim 20, wherein said chamber further comprises:

a first wall having an inner and an outer surface, and opposed side walls extending from said inner surface to define a container for the fluid sufficient to permit at least one drop to be dispensed therefrom; and a platform having an aperture in fluid communication with said container, said aperture having dimensions which preclude gravitational flow of the fluid from the chamber;

said platform and said first wall being connected in a manner which is sufficient to prevent spreading of drops of dispensed fluid onto said outer surface;

said platform having an exterior surface defining a drop-contacting area which will support a properly-formed drop of predetermined volume, said volume being substantially fixed and within the range of about 1 and about 30 $\mu$l.

24. A dispenser for use with a biological fluid container comprised of a tubular member defining a compartment for holding fluid and a stopper at one end;

the dispenser comprising 1. a dispensing chamber, and
2. passage means for fluidly connecting the chamber to the compartment, said passage means being selectively blocked by said valve and including a tubular member one end of which is capable of penetrating into the compartment, and a hollow member connected to said tubular member with a fixed opening for constant fluid communication with the container, at least one valve disposed at least partially within said hollow member and between said tubular member and said chamber to selectively block said passage means, said valve having at least one passageway and being rotatably mounted about an axis so as to movably align the passageway with said fixed opening, and further including means for rotating said valve passageway into and out of alignment with said opening.

25. A dispenser for use with a source of biological fluid comprised of a tubular member defining a compartment for holding the fluid;

the dispenser comprising 1. a dispensing chamber,
2. passage means for fluidly connecting the chamber to the compartment, said passage means including a tubular member and a hollow member, said chamber being mounted at least partially within said hollow member, said tubular member having an entrance end and an exit end,
3. at least one valve positioned between said ends to selectively block said passage means, said valve being capable of fluid flow through the passage means only towards said exit end in response to a differential pressure across the valve, and
4. evacuating means for reducing the air pressure in said passage means with respect to the separator compartment so as to cause flow of biological fluid through said valve.

26. The dispenser as defined in claim 25 wherein said passage means includes a tubular member one of which is capable of projecting into said compartment to define said entrance end, and a hollow member connected to said tubular member, said chamber being mounted at least partially within said hollow member, and further including a second valve positioned so as to selectively block flow of biological fluid from said one valve to said chamber, said second valve being capable of fluid flow only into said chamber in response to a differential pressure across said second valve;

and pressurizing means for increasing the pressure within said hollow member with respect to said chamber so as to cause flow of fluid through said second valve.

27. A dispenser for use with a source of biological fluid comprised of a tubular member defining a compartment for holding the fluid;

the dispenser comprising two hollow members movably mounted one partially within the other, one of said members being a compartment having opposed ends, one end being open for fluid communication with respect to the other member;

said one member comprising a dispensing chamber having a platform at one side thereof suitable for the formation of pendant drops, said platform having an aperture in fluid communication with said chamber, the maximum dimension of the aperture being sufficiently small as to prevent gravitational flow of the serum;

a passageway fluidly connecting the one member to the chamber;

and means for blocking flow of biological fluid from said other member through said passageway when the members are moved together and for permitting flow when said members are moved apart.

28. The dispenser as defined in claim 27 wherein said chamber further comprises:

a first wall having an inner and an outer surface, and opposed side walls extending from said inner surface to define a container for the fluid sufficient to permit at least one drop to be dispensed therefrom; and a platform having an aperture in fluid communication with said container, said aperture having dimensions which preclude gravity flow of the fluid from the chamber;

said platform and said first wall being connected in a manner which is sufficient to prevent spreading of drops of dispensed fluid onto said outer surface;

said platform having an exterior surface defining a drop-contacting area which will support a properly-formed drop of predetermined volume, said volume being substantially fixed and within the range of about 1 and about 30 $\mu$l.

* * * * *

UNITED STATES PATENT AND TRADEMARK OFFICE

CERTIFICATE OF CORRECTION

PATENT NO. : 3,977,568

DATED : August 31, 1976

INVENTOR(S) : David S. Smith

It is certified that error appears in the above-identified patent and that said Letters Patent are hereby corrected as shown below:

Column 1, line 66, "548,670", should read --545,670--.

Column 8, line 14, "buttom", should read --button--.

Column 9, line 66, "104", should read --404--.

Column 16, line 16, "gravity", should read --gravitational--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,977,568 Dated August 31, 1976

Inventor(s) David S. Smith

It is certified that error appears in the above-identified patent and that said Letters Patent are hereby corrected as shown below:

Column 12, line 56, "define said" should read -- define an --;

Column 12, line 60, "an" should read -- said --.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,977,568

DATED : August 31, 1976

INVENTOR(S) : David S. Smith

It is certified that error appears in the above-identified patent and that said Letters Patent are hereby corrected as shown below:

Column 12, line 56, "define said" should read --define an--.

Column 12, line 60, "an" should read --said--.

Column 14, lines 24 and 25, "to the compartment, said passage means being selectively blocked by said valve and including a" should read --to the compartment, said passage means including a--.

Column 14, delete lines 61, 62 and 67.

Column 14, line 63, "ing into said compartment to define said entrance" should read --tubular member projects into said compartment to define said entrance--.

Column 14, line 65, "and a hollow member connected to said tubular" should read --said hollow member being connected to said tubular--.

UNITED STATES PATENT OFFICE
CERTIFICATE OF CORRECTION

Patent No. 3,977,568 Dated August 31, 1976

Inventor(s) David S. Smith

It is certified that error appears in the above-identified patent and that said Letters Patent are hereby corrected as shown below:

Column 14, line 68, "said hollow member, and further including a sec-" should read -- and further including a sec- --.

This Certificate supersedes Certificate issued April 26, 1977.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*